US008783332B2

(12) United States Patent
Grüss

(10) Patent No.: US 8,783,332 B2
(45) Date of Patent: Jul. 22, 2014

(54) DEVICE AND METHOD FOR POSITIONING AT LEAST ONE OF TWO CASTING ROLLS IN A CONTINUOUS CASTING PROCESS FOR PRODUCING A METAL STRIP

(75) Inventor: Ansgar Grüss, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/876,784

(22) PCT Filed: Sep. 28, 2011

(86) PCT No.: PCT/EP2011/066820

§ 371 (c)(1),
(2), (4) Date: Mar. 28, 2013

(87) PCT Pub. No.: WO2012/041882

PCT Pub. Date: Apr. 5, 2012

(65) Prior Publication Data

US 2013/0213599 A1 Aug. 22, 2013

(30) Foreign Application Priority Data

Sep. 29, 2010 (EP) ..... 10181756

(51) Int. Cl.
*B22D 11/06* (2006.01)
*B22C 19/04* (2006.01)

(52) U.S. Cl.
USPC ..... 164/428; 164/154.8

(58) Field of Classification Search
USPC ..... 164/428, 480, 154.8
See application file for complete search history.

(56) References Cited

U.S. PATENT DOCUMENTS

| | | | | |
|---|---|---|---|---|
| 4,976,304 | A | 12/1990 | Buchner | 164/428 |
| 6,167,942 | B1 | 1/2001 | Fish et al. | 164/428 |
| 7,913,744 | B1 | 3/2011 | Marti et al. | 164/428 |
| 2009/0139685 | A1 * | 6/2009 | Hayashi et al. | 164/480 |

FOREIGN PATENT DOCUMENTS

| | | | | |
|---|---|---|---|---|
| DE | 898135 | C | 11/1953 | B22D 11/00 |
| DE | 3624114 | A1 | 1/1988 | B22D 11/06 |
| DE | 69813424 | T2 | 3/2004 | B22D 11/06 |
| DE | 102008057818 | A1 | 6/2009 | B22D 11/06 |
| EP | 1092490 | A1 | 4/2001 | B22D 11/06 |
| WO | 2010/049209 | A1 | 5/2010 | B21B 38/02 |
| WO | 2012/041882 | A1 | 4/2012 | B22D 11/06 |

OTHER PUBLICATIONS

International Search Report and Written Opinion, Application No. PCT/EP2011/066820, 19 pages, Dec. 14, 2011.

* cited by examiner

*Primary Examiner* — Kevin P Kerns
*Assistant Examiner* — Steven Ha
(74) *Attorney, Agent, or Firm* — King & Spalding L.L.P.

(57) ABSTRACT

A device and method are disclosed for positioning at least one of two casting rolls in a continuous casting process for producing a metal strip. The device and the method allow adjusting or modifying the casting gap between the casting rolls during the ongoing operation, thereby having an influence on the strip thickness and the strip profile of the produced metal strip.

14 Claims, 5 Drawing Sheets

DEVICE AND METHOD FOR POSITIONING AT LEAST ONE OF TWO CASTING ROLLS IN A CONTINUOUS CASTING PROCESS FOR PRODUCING A METAL STRIP

CROSS-REFERENCE TO RELATED APPLICATIONS

This application is a U.S. National Stage Application of International Application No. PCT/EP2011/066820 filed Sep. 28, 2011, which designates the United States of America, and claims priority to EP Patent Application No. 10181756.7 filed Sep. 29, 2010 The contents of which are hereby incorporated by reference in their entirety.

TECHNICAL FIELD

The disclosure relates to a device for positioning at least one of two casting rolls for producing metal strip. The disclosure also relates to a method for positioning at least one of two casting rolls in a casting process for producing metal strip.

BACKGROUND

Devices and methods of the type mentioned in the introduction are already known from DE 698 13 424 T2. Here the continuous casting of metal strip using a twin-roll casting device is described in which molten metal is poured into a casting gap between two cooled, counter-rotating casting rollers or casting rolls. The molten metal is fed to the casting rolls by at least one nozzle arrangement disposed above the casting gap, a so-called melt pool being formed above the casting gap between the casting rolls. The term "casting gap" refers to the region in which the casting roll surfaces are closest together. Usual casting gap widths are e.g. in the order of <10 mm, in particular in the order of <5 mm. At the surface of each casting roll, solidified metal in contact with the melt pool forms a strip shell, the two strip shells being brought together in the casting gap between the casting rolls at the "kissing point" or roll nip to produce the metal strip which is withdrawn vertically downward from the casting gap by the force of gravity. At this point in time there remains between the strip shells a mushy, metallic connecting layer which is flexible and is increasingly cooled and likewise solidifies only during withdrawal of the metal strip vertically downward from the casting gap under the force of gravity. In order to prevent liquid metal from flowing out in the region of the two ends of the melt pool, the melt pool being formed is usually enclosed between two lateral plates or dams which are in sliding engagement with the end faces of the casting rolls.

Near net shape metal strip is produced which is either taken off as finished strip immediately after passage through the casting gap and cooling, or rolled to a desired thickness or net shape and cooled.

The positioning of the casting rolls in a casting process of this kind is complex and difficult. The thickness (gauge) and/or the profile of the metal strip produced are dependent primarily on the condition of the casting rolls, the contact time and the contact arc of strip shell and casting roll as well as on the position of the kissing point. For example, not only the casting roll speed but also the width of the gap between the casting rolls must be precisely set in order to produce metal strip of the desired gauge and the desired profile.

As disclosed in DE 698 13 424 T2, at least one of the casting rolls is mounted on a pair of movable roll carriers which allow the casting roll to move toward or away from the other casting roll. A stop device limits the movement of the casting roll(s) and defines the minimum achievable gap width. A roll cassette frame in which the casting rolls and stop devices are mounted is raised to the operating position by means of a lifting device having hydraulic cylinder units, and is inserted and immovably clamped in this position using horizontal hydraulic cylinder units so that the gap width is fixed.

Even if only one parameter affecting the strip thickness and the strip profile, such as the condition of the casting rolls during the ongoing casting process, is changed, e.g. by a change in the surface profile of the casting roll(s), the strip thickness and/or the strip profile of the metal strip produced will change. Changes in the area of a coolant supply to the casting rolls or in the area of the drive of the casting rolls can also affect the strip thickness and/or strip profile achieved. The effect also frequently occurs that the metal strip now has a different strip thickness viewed across its width. Changing the originally specified gap width by millimeters by changing the distance between the ends of the two casting rolls, at one or both ends of the casting rolls, may be necessary in order to retain the strip thickness and/or strip profile. A necessary adjustment of the gap width to correct the position of the casting rolls while casting is in progress has hitherto not been possible according to conventional techniques.

SUMMARY

One embodiment provides a device for positioning at least one of two casting rolls in a continuous casting process for producing metal strip, comprising: at least one frame element; at least one pair of lifting elements for each casting roll to be positioned, each lifting element rotatably mounted at a first end about a fixed first axis of rotation disposed on the at least one frame element, wherein the first axes of rotation of the lifting elements have a common first longitudinal axis; for each lifting element, a lifting cylinder disposed on the at least one frame element, wherein the lifting cylinder acts on a second end of the respective lifting element and is therefore connected in an articulated manner; at least one seating arrangement for each lifting element for accommodating at least one bearing arrangement for rotatably mounting one end of the casting roll to be positioned, wherein the at least one seating arrangement is disposed on an upper side of the lifting element; and for each lifting element, a lever stop disposed on the at least one frame element, wherein a contact surface disposed on an underside of the respective lifting element is in contact with a stop surface of the respective lever stop at least when the respective lifting cylinder is in an idle position.

In a further embodiment, the device comprises a second pair of lifting elements, each rotatably mounted at a first end about a fixed second axis of rotation disposed on the at least one frame element, wherein the second axes of rotation have a common second longitudinal axis which is disposed parallel to the first longitudinal axis, and wherein the first ends of the lifting elements of the two pairs of lifting elements are facing one another.

In a further embodiment, the device comprises a drive unit for each casting roll, each drive unit configured to impart rotation about its longitudinal axis to the respective casting roll positionable by means of the pair of lifting elements.

In a further embodiment, the drive unit is assigned to one of the lifting elements of the respective pair of lifting elements and is disposed on the at least one bearing arrangement disposed on the lifting element.

In a further embodiment, a counterweight is disposed opposite the drive unit.

In a further embodiment, the spacing between the lifting elements of the respective pair of lifting elements can be changed such that the spacing can be adjusted to the length of the casting roll to be supported by the pair of lifting elements.

In a further embodiment, the region of the first axis or axes of rotation and possibly of the second axis or axes of rotation, at least one coolant supply line is connected for supplying coolant to the respective casting roll.

In a further embodiment, the at least one bearing arrangement is connected to the at least one seating arrangement via a pivot bearing.

In a further embodiment, the at least one bearing arrangement is height-adjustable with respect to the at least one seating arrangement.

In a further embodiment, the at least one bearing arrangement for each lifting element has at least one force measuring unit for determining the compressive force exerted by the casting roll on the at least one bearing arrangement.

In a further embodiment, a frame element is present for each pair of lifting elements.

In a further embodiment, the device comprises at least one of: a position encoder installed on each lifting cylinder and a rotary encoder installed on each axis of rotation.

In a further embodiment, the device additionally comprises a control device configured to set the position of the lifting cylinders as a function of at least one casting parameter affecting at least one of a strip thickness and a surface profile of the metal strip.

In a further embodiment, the casting parameters can be selected from the group consisting of: a compressive force exerted by the at least one casting roll on the at least one bearing arrangement, a surface quality of the at least one casting roll, a strip thickness of the metal strip, a speed of the metal strip, a temperature or temperature distribution of the metal strip, a spatial position of the metal strip, a surface profile of the metal strip, a gap width of the casting gap, a temperature of a molten metal to be cast, a temperature of a coolant for cooling the casting rolls, and drive data of the drive units for driving the casting rolls.

Another embodiment provides a method for positioning at least one of two counter-rotating casting rolls in a casting process for producing metal strip, wherein a molten metal to be cast is fed from above into a casting gap formed between the two casting rolls, wherein a melt pool is created above the casting gap in contact with the two rotating casting rolls, the method comprising: positioning the at least one casting roll by moving the lifting cylinders to an operating position; driving the at least one casting roll rotating about its longitudinal axis by means of a drive unit; detecting at least one casting parameter affecting at least one of a strip thickness and a surface profile of the metal strip; and correcting the operating positions of at least one lifting cylinder as a function of the at least one casting parameter detected.

In a further embodiment, the at least one casting parameter is selected from the group consisting of: a compressive force exerted by the at least one casting roll on the at least one bearing arrangement, a surface quality of the at least one casting roll, a strip thickness of the metal strip, a speed of the metal strip, a temperature or temperature distribution of the metal strip, a spatial position of the metal strip, a surface profile of the metal strip, a gap width of the casting gap, a temperature of a molten metal to be cast, a temperature of a coolant for cooling the casting rolls, and drive data of the drive units for driving the casting rolls.

In a further embodiment, the correcting of the at least one operating position is carried out as a function of at least the casting parameter strip thickness of the metal strip or the surface profile of the metal strip.

BRIEF DESCRIPTION OF THE DRAWING

Exemplary embodiments will be explained in more detail below based on the schematic drawings, wherein.

DETAILED DESCRIPTION

Figure 1:
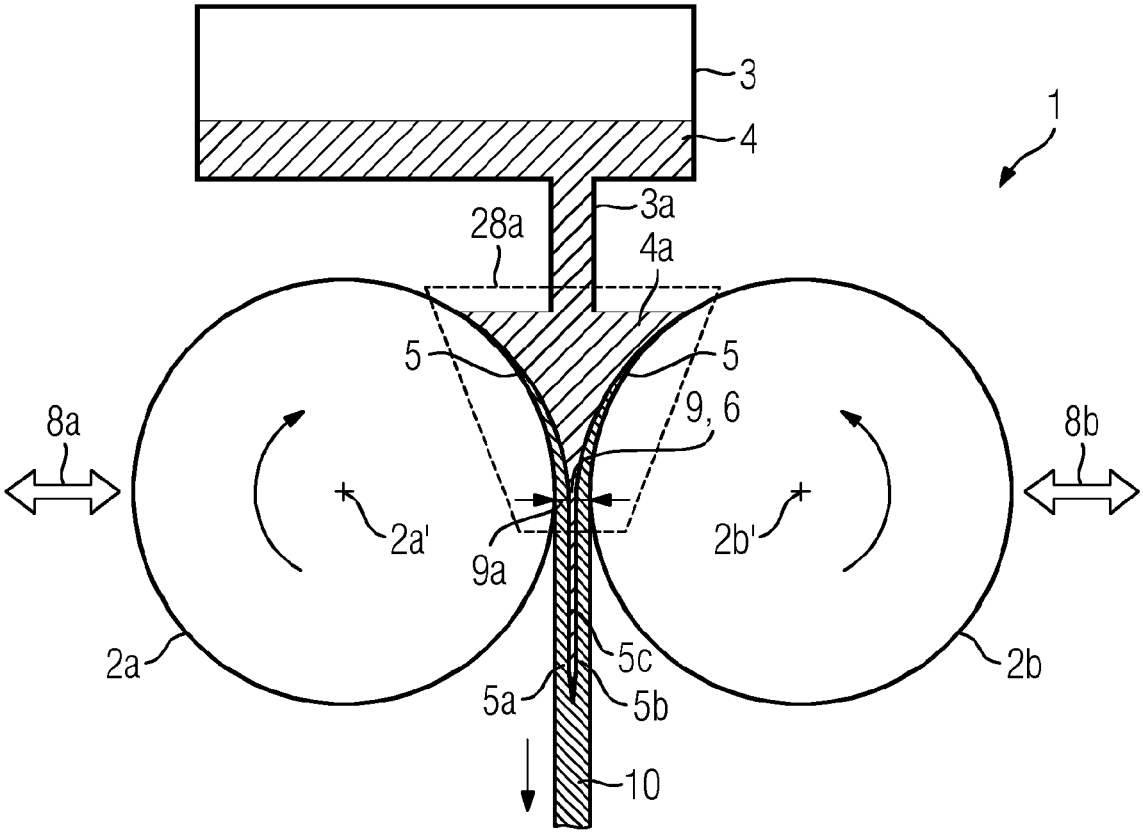
FIG. 1 shows a schematic side view of a device for positioning casting rolls, i.e. viewed toward the end faces of the casting rolls.

Embodiments of the present disclosure provide a device and a method for positioning casting rolls in a continuous casting process for producing metal strip, said device and method enabling the gap width to be adjusted during casting.

This object is achieved for the device for positioning at least one of two casting rolls in a continuous casting process for producing metal strip, said device designed to comprise the following:

at least one frame element, at least one pair of lifting elements for each casting roll to be positioned, the lifting elements of which are each rotatably mounted at a first end about a fixed first axis of rotation disposed on the at least one frame element, wherein the first axes of rotation of the lifting elements have a common first longitudinal axis, for each lifting element, a lifting cylinder disposed on the at least one frame element, wherein the lifting cylinder acts on a second end of the respective lifting element and is therefore connected in an articulated manner, at least one seating arrangement for each lifting element for accommodating at least one bearing arrangement for rotatably mounting one end of the casting roll to be positioned in each case, wherein the at least one seating arrangement is disposed on an upper side of the lifting element, and for each lifting element, a lever stop disposed on the at least one frame element, wherein a contact surface disposed on an underside of the respective lifting element is in contact with a surface of the respective lever stop, at least when the respective lifting cylinder is in its idle position.

This object is achieved for the method for positioning at least one of two counter-rotating casting rolls in a casting process for producing metal strip, wherein a molten metal to be cast is introduced from above into a casting gap formed between the two casting rolls, wherein a melt pool in contact with the two rotating casting rolls is created above the casting gap, and wherein a device as disclosed herein is used, said method comprising the following steps:

a) positioning the at least one casting roll by moving the lifting cylinders to an operating position;

b) driving the at least one casting roll rotating about its longitudinal axis by means of a drive unit;

c) detecting at least one casting parameter affecting the strip thickness and/or surface profile of the metal strip, in particular a casting parameter from the group comprising
   - a compressive force of the positioned casting roll on the at least one bearing arrangement,
   - a surface quality of the casting rolls,
   - a strip thickness and/or speed and/or temperature and/or temperature distribution and/or spatial position and/or surface profile of the formed metal strip withdrawn vertically downward from the casting gap,
   - a casting gap width,
   - a temperature of the molten metal to be cast;
   - a temperature of a coolant for cooling the casting rolls;
   - drive data of the drive units; and d) correcting the operating position of at least one lifting cylinder as a function of the at least one casting parameter detected.

The disclosed device and the method according enable the width of the gap between the casting rolls to be adjusted or changed while casting is in progress and allow the contact arc between metal to be cast and casting roll to be changed, thereby enabling the strip thickness and/or strip profile of the metal strip produced to be promptly influenced during the ongoing casting process.

Each end of the at least one casting roll can be positioned, largely independently of its other end, in the usually required adjustment range for the gap width. This is achieved by the lifting cylinders being actuatable independently of one another.

This not only makes it possible to adjust the gap width such that the position of the at least one casting roll is changed relative to the other casting roll, with the longitudinal axes of the casting rolls remaining in parallel alignment. In this first case the casting gap has a rectangular cross section if the casting rolls are viewed perpendicularly from above. But a gap width change is also possible whereby the position of the at least one casting roll relative to the other casting roll is changed such that the longitudinal axes of the casting rolls are not or are no longer aligned parallel. In this case the casting gap has a quadrangular cross section if the casting rolls are viewed perpendicularly from above, the long sides of the quadrilateral, following the longitudinal axes of the casting rolls, not being aligned parallel to one another when viewed perpendicularly from above. The casting roll longitudinal axes are spaced father apart at one end than at the other end.

According to some embodiments, optimum adjustment of the width of the gap between the casting rolls in response to the changing surface profiles of the casting rolls during the casting operation, e.g. due to wear, and other changing parameters affecting the strip thickness and/or strip profile of the metal strip to be produced is possible. Precise setting of the gap width even prior to mounting the device in the casting position or rather at the place of installation in a strip production system is no longer required.

The strip thickness and/or strip profile of the metal strip produced can therefore be advantageously kept particularly uniform, thereby improving the quality of the metal strip. In addition, longer casting times can be implemented using the same set of casting rolls, as it is possible to adjust the gap width to the changing condition of the casting rolls, and the maintenance intervals of the casting rolls can be increased. This considerably reduces the metal strip production costs.

In the device's idle position in which no energy supply is present and the casting gap is at its maximum width, the lifting elements rest on the lever stops by virtue of their own weight, wherein a contact surface disposed on the underside of the respective lifting element lies against a stop surface of the respective lever stop. In this position simple inspection, maintenance and position calibration of the device and the casting gap can be carried out.

The disclosed device and method may be particularly suitable for producing steel strip, e.g., high-grade or carbon steel strip.

Metal strip ranging from 0.5 to 2 m in width, in particular from 1 to 1.5 m, and having a thickness of <10 mm, e.g., <5 mm may be produced using the disclosed device and method.

To detect the actual gap width it has proved effective to measure the minimum spacing between the casting rolls using a distance measurement.

In one embodiment of the device, it is set up for positioning the two casting rolls in the continuous casting process for producing metal strip and comprises a second pair of lifting elements, the lifting elements of which are each rotatably mounted at a first end about a fixed second axis of rotation disposed on the at least one frame element, wherein the second axes of rotation have a common second longitudinal axis disposed parallel to the first longitudinal axis, wherein the first ends of the lifting elements of the two pairs of lifting elements face toward one another. This enables the positions of both ends of the two casting rolls to be changed, a largely independent position change of all four ends being possible within the usual adjustment range.

There may be provided, for each pair of lifting elements, a drive unit which is designed to impart rotation about its longitudinal axis to the casting roll positionable by means of the pair of lifting elements. This enables each of the two casting rolls to be driven independently of the other casting roll in respect of its rotational speed.

It has been found advantageous if the drive unit is assigned to one of the lifting elements of the respective pair of lifting elements and is mounted in a space-saving manner on the at least one bearing arrangement disposed on the lifting element. However, it is also alternatively possible for it to be mounted e.g. on the frame element. Such an arrangement of the drive unit, possibly including the power supply, minimizes its disturbing effect on the casting gap.

A counterweight may be disposed on the other end of the casting roll opposite the drive unit. This prevents distortion of the casting roll and ensures a uniform rotation speed of the casting roll.

The spacing between the lifting elements of the respective pair of lifting elements may be varied such that the spacing can be adjusted to the length of the casting roll to be held by the pair of lifting elements. In this way the device can be operated using casting rolls of different lengths and metal strip of different widths can be produced. Such an adjustment of the spacing between the lifting elements of the respective pair of lifting elements is obviously only possible before the start of the casting process when the desired casting rolls are inserted, but not while casting is in progress.

In some embodiments, in the region of the first axis (or axes) of rotation and possibly of the second axis (or axes) of rotation at least one coolant supply line is connected via which the respective casting roll can be supplied with coolant. This ensures sufficient cooling of the molten metal on the respective casting roll with the formation of a strip shell as well as reliable detachment of the shells from the surfaces of the casting rolls after passage through the casting gap. The effect of changes in the coolant supply on the casting gap is minimized. Additional connections for other media, etc. may be also installed in the region of the first and/or second axis (or axes) of rotation.

It has been found advantageous for the at least one bearing arrangement to be connected to the at least one seating arrangement via a pivot bearing. In particular, the pivot bearings each slide on horizontally disposed carriages. These measures reduce the mechanical loading in the region of the lifting cylinders.

In order to enable optimum setting of the kissing point to be performed, the at least one bearing arrangement may be height-adjustable with respect to the at least one seating arrangement.

When the strip shells are brought together, the casting rolls are subjected to high forces, wherein spring elements having adjustable spring stiffness and/or servo-hydraulic (individual) force control loops can be used for a positioning system.

The at least one bearing arrangement for each lifting element may have at least one force measuring unit, particularly in the form of a load cell, for determining the compressive force exerted by the casting roll on the at least one bearing arrangement. This may be assigned to the positioning system, thereby enabling damage to the bearing unit due to overload to be prevented.

It has been found effective if—likewise assigned to the positioning system—a position encoder is installed on each lifting cylinder and/or a rotary encoder is installed on each first and/or second axis of rotation, thereby enabling the current positioning of the casting roll to be unambiguously detected.

A frame element can be provided for each pair of lifting elements, wherein the metal strip to be produced can be fed through vertically downward between the frame elements. If two pairs of lifting elements are present, only one frame element to which both pairs of lifting elements are attached may be provided.

In particular, the device additionally comprises at least one control device which is designed to set a position of the lifting cylinders as a function of casting parameters affecting the strip thickness and/or surface profile of the metal strip, in particular of casting parameters from the group comprising

- a compressive force of the at least one casting roll on the at least one bearing arrangement,
- a surface quality of the at least one casting roll,
- a strip thickness and/or speed and/or temperature and/or temperature distribution and/or spatial position and/or surface profile of the metal strip produced,
- a casting gap width,
- a temperature of the molten metal to be cast;
- a temperature of a coolant for cooling the casting rolls;
- drive data of the drive units.

This allows particularly rapid and precise positioning of the at least one casting roll while casting is in progress. Alternatively, manual actuation of the lifting cylinders for the purpose of changing the gap width is likewise possible.

For the disclosed method it has been found advantageous for the correction of the at least one operating position to be carried out as a function of at least the casting parameter strip thickness of the metal strip and/or surface profile or strip profile of the metal strip. These values are detected on the metal strip and in particular transmitted to the least one control device which determines therefrom the required gap width change and sets the required gap width by changing the position of the lifting cylinders.

To acquire the surface profile of the metal strip, flatness measuring equipment is normally used as described, for example, in WO 2010/049209 A1.

In the event of device electrical supply failure, the lifting cylinders are lowered and the casting gap opens to the maximum possible gap width, so that a safe position for man and machine is assumed. The risk of damage to the casting rolls is minimized.

FIG. 1 shows a schematic side view of a device 1 for positioning two casting rolls 2*a*, 2*b* counter-rotating about their longitudinal axes 2*a*', 2*b*', i.e. viewed toward the end faces of the casting rolls 2*a*, 2*b*. The device 1 is a so-called twin-roll caster in which molten metal 4 is fed from a melt tank 3 disposed above the device 1 into a casting gap 9 between the two cooled, counter-rotating casting rolls 2*a*, 2*b*. The molten metal 4 is applied to the casting rolls 2*a*, 2*b* by at least one nozzle arrangement 3*a* disposed above the casting gap 9, wherein a so-called melt pool 4*a* is created above the casting gap 9 between the casting rolls 2*a*, 2*b*. The term "casting gap" 9 refers to the region in which the distance between the casting roll surfaces, i.e. the gap width 9*a*, is at its smallest. The gap width 9*a* of the casting gap 9 is typically <10 mm, in particular in the range 2 to 6 mm, depending on the desired strip gauge.

A metal deposit 5 is formed on each cooled casting roll 2*a*, 2*b*, wherein, as the contact time with the casting roll increases, the deposited metal increasingly solidifies and creates a strip shell 5*a*, 5*b*, the two strip shells 5*a*, 5*b* being brought together in the casting gap 9 between the casting rolls 2*a*, 2*b* at the so-called kissing point 6 to form the metal strip 10. Between the strip shells 5*a*, 5*b* there is still present at this time a mushy metallic connecting layer 5*c* which during withdrawal of the metal strip 10 vertically downward from the casting gap 9 under the effect of gravity is increasingly cooled and likewise solidifies. In order to prevent liquid metal 4 from flowing out in the region of the two ends of the melt pool 4*a* and/or the ends of the casting rolls 2*a*, 2*b*, the melt pool 4*a* being formed is usually enclosed between two lateral plates 28*a*, 28*b* which are in sliding engagement with the end faces of the casting rolls 2*a*, 2*b* and whose position is here indicated only by a dashed line for the sake of clarity. The gap width 9*a* of the casting gap 9 can be set by means of the forces 8*a*, 8*b* during the ongoing casting process. Thus it is possible to respond quickly and reliably to changes in the casting operation, such as changing surface quality of the casting rolls 2*a*, 2*b*.

Figure 2:
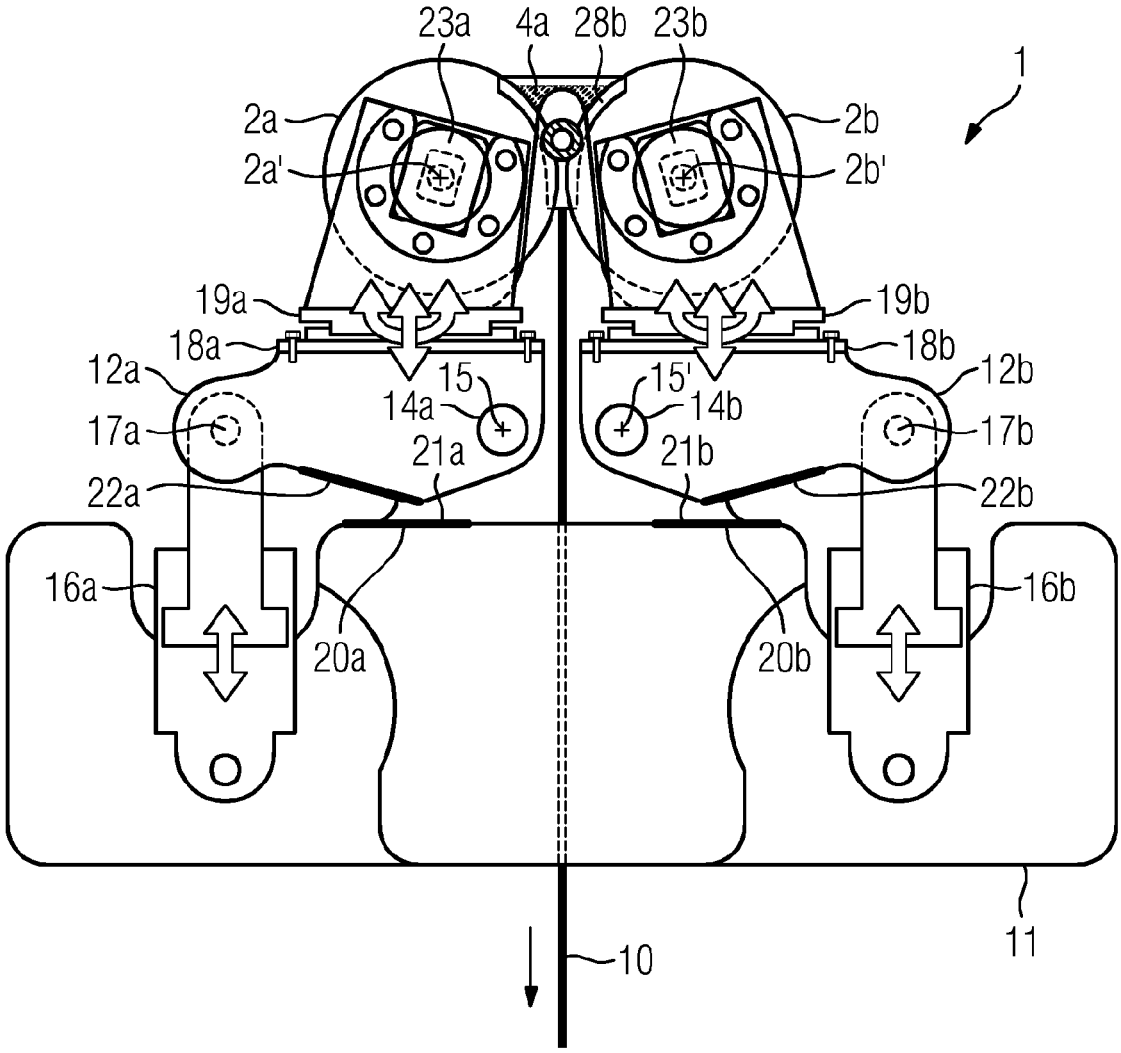
FIG. 2 shows a detailed side view of a device for positioning casting rolls, i.e. viewed toward the end faces of the casting rolls as per FIG. 1.
Figure 3:
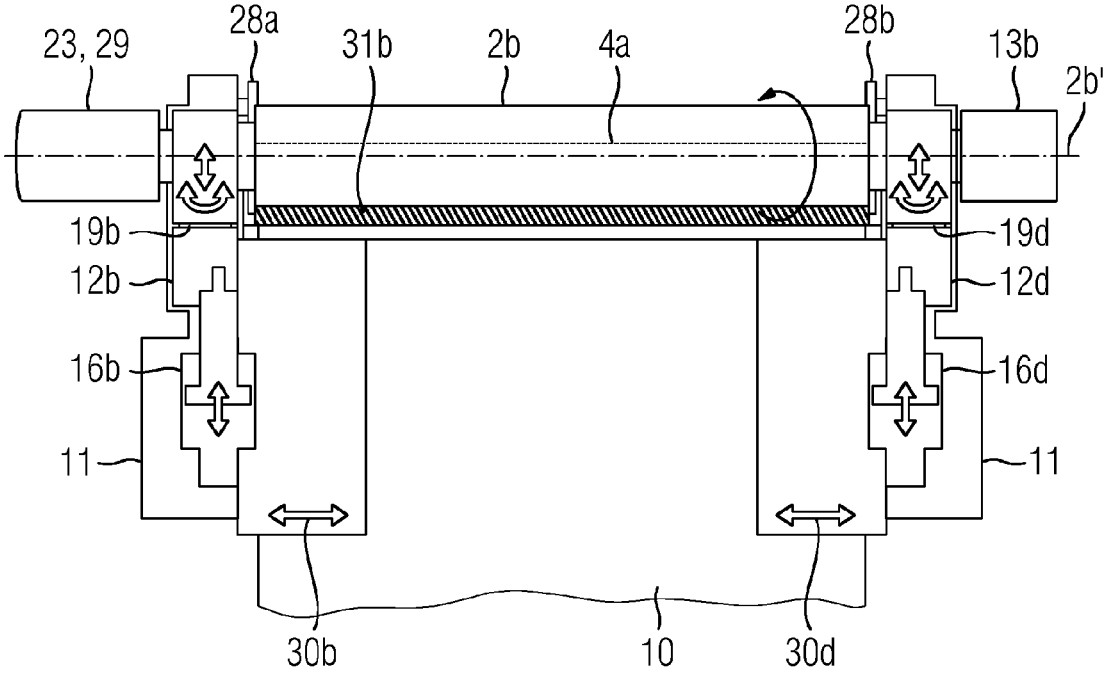
FIG. 3 shows another detailed side view of the device according to FIG. 2, here viewed toward the lateral surface of one of the casting rolls.
Figure 4:
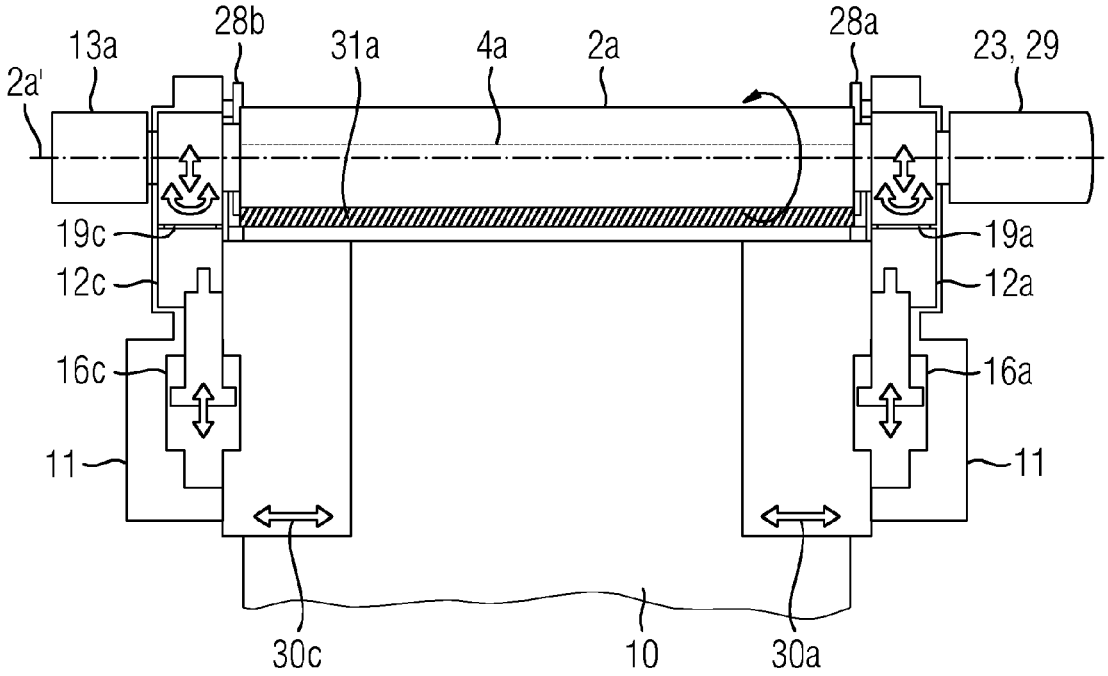
FIG. 4 shows another detailed side view of the device according to FIG. 2 and FIG. 3, here viewed toward the lateral surface of the other casting roll.

FIG. 2 shows a detailed side view of the device 1 for positioning casting rolls 2*a*, 2*b*, viewed toward the end faces of the casting rolls 2*a*, 2*b* as in FIG. 1. FIG. 3 shows another detailed side view of the device 1 according to FIG. 2, viewed toward the lateral surface of the casting roll 2*b*. FIG. 4 shows another detailed side view of the device 1 according to FIG. 2 and FIG. 3, viewed toward the lateral surface of the casting roll 2*a*. Identical elements are identified by the same reference characters as in FIG. 1.

The device 1 comprises a frame element 11 and four lifting elements 12*a*, 12*b*, 12*c*, 12*d*. One pair of lifting elements 12*a*, 12*c* is assigned to the casting roll 2*a*. The lifting elements 12*a*, 12*c* are each rotatably mounted at a first end about a fixed first axis of rotation disposed on the frame element 11, wherein, as shown in FIG. 2, only the first axis of rotation 14*a* is visible and wherein the first axes of rotation of the lifting elements 12*a*, 12*c* have a common first longitudinal axis 15. Another pair of lifting elements 12*b*, 12*d* is assigned to the casting roll 2*b*. The lifting elements 12*b*, 12*d* are each rotatably mounted at a first end about a fixed second axis of rotation disposed on the frame element 11, only the second axis of rotation 14*b* being visible in FIG. 2, wherein the second axes of rotation of the lifting elements 12*b*, 12*d* have a common second longitudinal axis 15'.

For each lifting element 12*a*, 12*b*, 12*c*, 12*d*, the device 1 additionally comprises a respective lifting cylinder 16*a*, 16*b*,

16*c*, 16*d* disposed on the frame element 11, wherein the lifting cylinder 16*a*, 16*b*, 16*c*, 16*d* acts on a second end of the respective lifting element 12*a*, 12*b*, 12*c*, 12*d* and is therefore connected in an articulated manner via a pivot 17*a*, 17*b*.

Additionally provided is a seating arrangement 18*a*, 18*b* for each lifting element 12*a*, 12*b*, 12*c*, 12*d* for accommodating a respective bearing arrangement 19*a*, 19*b*, 19*c*, 19*d* for rotatably mounting one end of the casting roll to be positioned 2*a*, 2*b*, wherein the seating arrangement 18*a*, 18*b* is disposed on an upper side of the lifting element 12*a*, 12*b*, 12*c*, 12*d*. The seating arrangements on the lifting elements 12*c* and 12*d* are of similar design and are not therefore shown in detail.

For each lifting element 12*a*, 12*b*, 12*c*, 12*d*, the device 1 additionally comprises a lever stop 20*a*, 20*b* disposed on the frame element 11, wherein a contact surface 22*a*, 22*b* disposed on an underside of the respective lifting element 12*a*, 12*b*, 12*c*, 12*d* is in contact with a stop surface 21*a*, 21*b* of the respective lever stop 12*a*, 12*b*, 12*c*, 12*d* at least when the respective lifting cylinder 16*a*, 16*b*, 16*c*, 16*d* is in the idle position. The lever stops, contact surface and stop surfaces assigned to the lifting elements 12*c* and 12*d* are of similar design to that shown FIG. 2 and are not therefore depicted in detail.

For each pair of lifting elements 12*a*, 12*c*; 12*b*, 12*d*, a drive unit 23*a*, 23*b* is provided which is designed to impart rotation about its longitudinal axis 2*a*', 2*b*' to the casting roll 2*a*, 2*b* which can be positioned by means of the pair of lifting elements 12*a*, 12*c*; 12*b*, 12*d*. The drive units 23*a*, 23*b* are connected in a synchronized manner to a motor 23 via a gear mechanism 29 (see FIG. 5). For each casting roll 2*a*, 2*b*, a casting roll cleaning device 31*a*, 31*b*, e.g. in the form of a cleaning brush, is provided which can be counter-rotating or fixed with respect to the casting roll 2*a*, 2*b* to be cleaned. The casting roll cleaning device 31*a*, 31*b* is used to remove deposit build-ups from the surface of the casting roll 2*a*, 2*b* and ensures a uniform surface quality of the metal strip 10.

The drive unit 23*a*, 23*b* is assigned to one of the lifting elements 12*a*, 12*b*, 12*c*, 12*d* of the respective pair of lifting elements 12*a*, 12*c*; 12*b*, 12*d* and is mounted on the bearing arrangement 19*a*, 19*b*, 19*c*, 19*d* disposed on the lifting element 12*a*, 12*b*, 12*c*, 12*d*. Disposed opposite the motor 23 are counterweights 13*a*, 13*b* which wholly or partially compensate the bending stress of the casting rolls 2*a*, 2*b* due to the laterally disposed motor 23, gear mechanism 29 and drive units 23*a*, 23*b*.

Prior to the start of the casting process, a spacing between the lifting elements 12*a*, 12*c*; 12*b*, 12*d* of the respective pair of lifting elements 12*a*, 12*c*; 12*b*, 12*d* can be varied such that the spacing can be adjusted to the length of the casting roll 2*a*, 2*b* to be supported by the pair of lifting elements 12*a*, 12*c*; 12*b*, 12*d*. The required adjusting devices 30*a*, 30*c* for adjusting the spacing between the lifting elements 12*a*, 12*c* of one casting roll 2*a* and the adjusting devices 30*b*, 30*d* for adjusting the spacing between the lifting elements 12*b*, 12*d* of the other casting roll 2*b* are represented merely schematically in the form of double arrows.

In the region of the first axis (or axes) of rotation 14*a* and possibly of the second axis (or axes) of rotation 14*b*, coolant supply lines 24, 24' are connected (see FIG. 5) via which the respective casting roll 2*a*, 2*b* is supplied with coolant. The coolant used can be water, for example, which is passed through the casting rolls 2*a*, 2*b* and discharged via coolant discharging lines 25, 25'.

The bearing arrangements 19*a*, 19*b*, 19*c*, 19*d* are connected to the respective seating arrangement 18*a*, 18*b* via a pivot bearing which slides on a horizontally disposed carriage. Such carriages as well as the casting roll bearings must be of low-friction design. In addition, the bearing arrangements 19*a*, 19*b*, 19*c*, 19*d* are height-adjustable with respect to the respective seating arrangements 18*a*, 18*b*. This is schematically represented in FIGS. 3 and 4 by double arrows in the region of the bearing arrangement 19*a*, 10*b*, 19*c*, 19*d*.

One or more independent frame elements 11 can be present for each pair of lifting elements 12*a*, 12*c*; 12*b*, 12*d*, wherein the metal strip 10 to be produced can be fed vertically downward past or through the frame elements 11 present. A plurality of frame elements 11 are in this case combined, e.g. via separate connector elements (not shown here), with all the other required components to form a cassette-like device which is installed in a strip production system 100 (see e.g. FIG. 6). If the frame arrangement 11 is of one-piece design, it is likewise combined with all the other required components to form a cassette-like device which is installed in a strip production system 100 (see e.g. FIG. 6).

Figure 5:
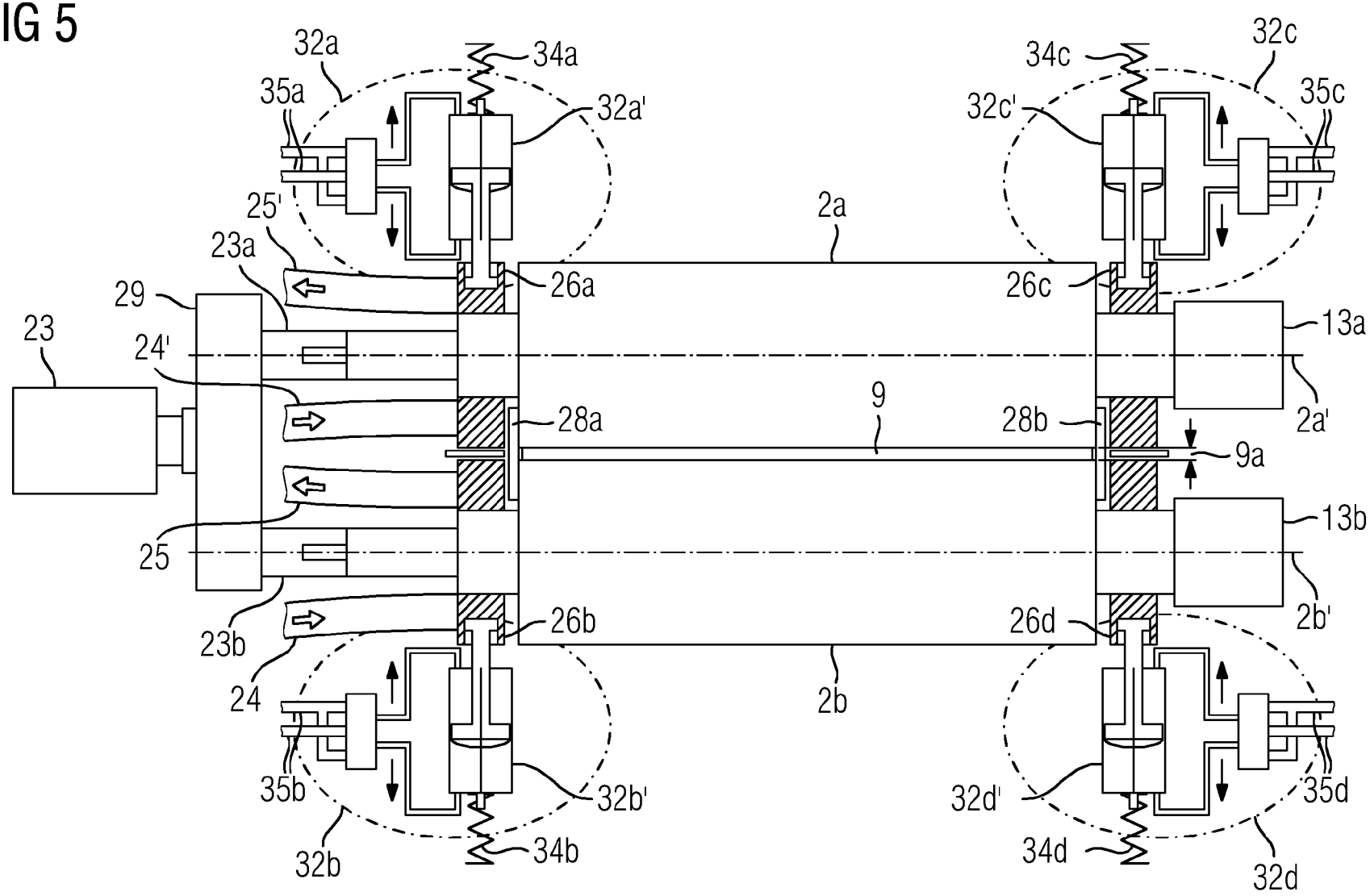
FIG. 5 shows a schematic plan view of the device according to FIGS. 2 to 4.

FIG. 5 schematically illustrates the device 1 according to FIGS. 2 to 4 in a plan view onto the casting rolls 2*a*, 2*b*. The same reference characters as in FIGS. 1 to 4 are used to denote identical elements. In this view, the motor 23, gear mechanism 29, drive units 23*a*, 23*b* and the counterweights 13*a*, 13*b* disposed opposite them are clearly visible. The arrangement of the coolant supply lines 24, 24' and coolant discharge lines 25, 25' is also clear. A position encoder system 32*a*, 32*b*, 32*c*, 32*d*—depicted schematically here—comprising position encoders 32*a*', 32*b*', 32*c*', 32*d*' is installed on each lifting cylinder 16*a*, 16*b*, 16*c*, 16*d*. The position encoder systems 32*a*, 32*b*, 32*c*, 32*d* each also comprise a spring element 34*a*, 34*b*, 34*c*, 34*d* of adjustable stiffness in order to produce the forces 8*a*, 8*b* for bringing together the strip shells 5*a*, 5*b* (compare FIG. 1), as well as suitable means of supplying pressure 35*a*, 35*b*, 35*c*, 35*d* for the position encoders 32*a*', 32*b*', 32*c*', 32*d*'.

For each lifting element 12*a*, 12*b*, 12*c*, 12*d*, the bearing arrangements 19*a*, 19*b*, 19*c*, 19*d* each optionally have a force measuring unit 26*a*, 26*b*, 26*c*, 26*d* which is likewise assigned to the positioning system 32*a*, 32*b*, 32*c*, 32*d*, for determining the compressive force exerted by the respective casting roll 2*a*, 2*b* on the respective bearing arrangement 19*a*, 19*b*, 19*c*, 19*d*.

Figure 6:
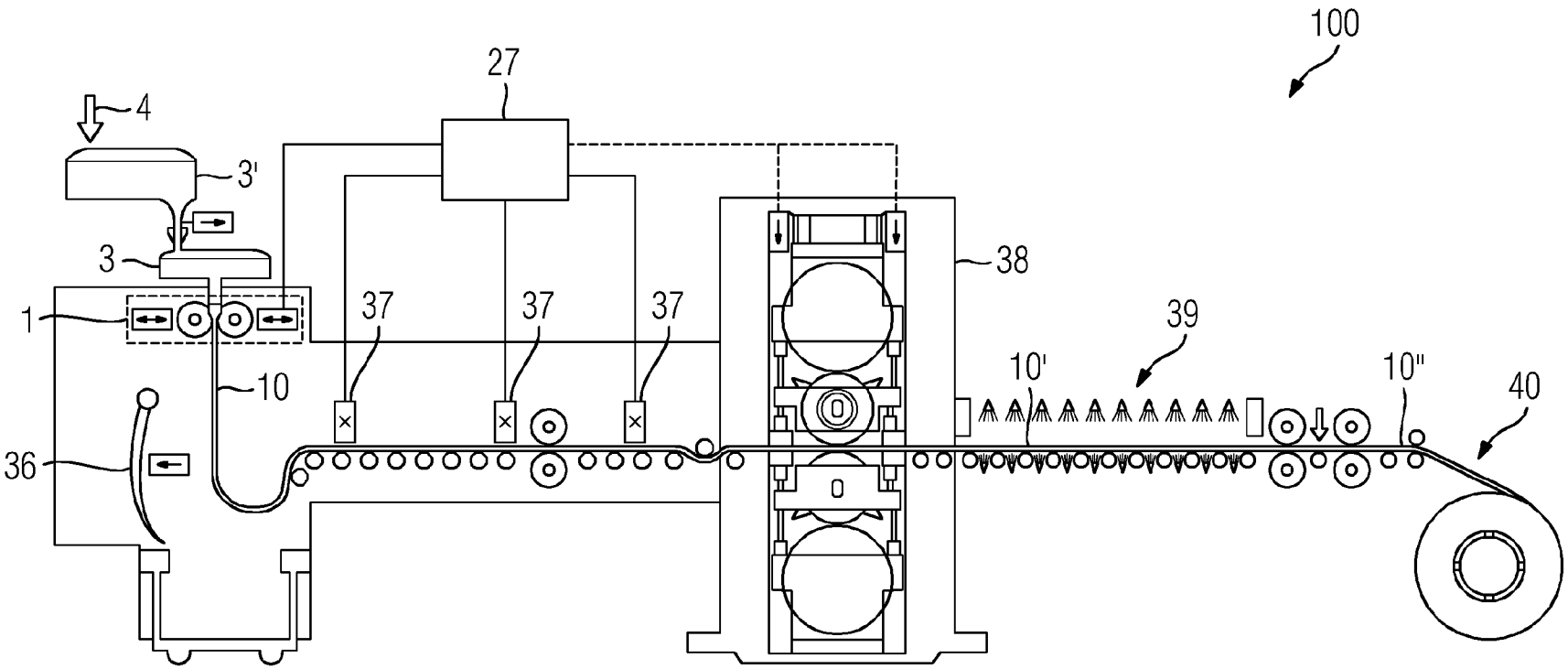
FIG. 6 shows a side view of a strip production system incorporating the device according to FIGS. 2 to 4.

FIG. 6 shows a side view of a strip production system 100 comprising the device 1 according to FIGS. 1 to 5 to which molten metal 4 is fed via melt tanks 3, 3'. A swiveling threader 36 by means of which the metal strip 10 is diverted in the horizontal direction only at the start of the casting process is likewise provided here, as well as a rolling mill stand 38 for reducing the thickness of the metal strip 10, a cooling section 39 for cooling the rolled metal strip 10' and a coiling arrangement 40 for the cooled metal strip 10". In the area of the coiling arrangement 40, the cooled metal strip 10" is cut to length and wound into coils.

The device 1 here comprises a control device 27 which is designed to control the position of the lifting cylinders 16*a*, 16*b*, 16*c*, 16*d* as a function of casting parameters affecting the strip thickness and/or surface profile of the metal strip, these parameters being determined by three measuring arrangements 37 on the metal strip 10 as it passes in the direction of the rolling mill stand 38. The casting parameters can be selected, for example, from the group comprising a compressive force exerted by the at least one casting roll 2*a*, 2*b* on the bearing arrangement 19*a*, 19*b*, 19*c*, 19*d*, a surface quality of the casting rolls 2*a*, 2*b*, a strip thickness and/or speed and/or temperature and/or temperature distribution and/or spatial position and/or surface profile of the metal strip 10 produced and/or a gap width 9*a* of the casting gap 9 and/or a temperature of the molten metal 4 to be cast, etc. Here the measuring arrangements 37 are used to determine the temperature of the metal strip 10, the surface profile of the metal strip 10 produced and the thickness of the metal strip 10 as casting parameters, on the basis of which the position of one or both casting roll(s) 2*a*, 2*b* is controlled. If, for example, the metal strip 10 is excessively thick on one side, the gap width 9*a* between the casting rolls 2*a*, 2*b* is reduced on that side by moving them closer together. This is done by correcting the operating positions of one or more lifting cylinders 16*a*, 16*b*, 16*c*, 16*d* as a function of the casting parameter(s) measured. On the other side of the metal strip 10, which is still within the desired thickness range, the gap width 9*a* is not changed. This provides a means of responding quickly and reliably to changes in the casting operation, such as changing surface quality or dimensions of the casting rolls 2*a*, 2*b*, in order to ensure consistent metal strip quality.

Alternatively, a strip production system can also solely comprise metal melt tanks 3, 3', a device 1, a cooling section 39 and a coiling arrangement 40 if finished strip is to be produced.

FIGS. 1 to 6 are merely intended to show, by way of example, possible devices and methods as well as possible uses of the device. Indeed it will be easily possible for the average person skilled in the art to change the design of the components, such as the shape of the lifting elements or of the casting rolls, the shape and number of the frame element(s), the shape of the respective bearing arrangement or seating arrangement, the position of the first and second axes of rotation, of the articulations, lever stops, stop surfaces etc., as well as the shape of the lateral plates and position of the coolant supply. Instead of lifting cylinders, other lifting elements can also be used, provided they are suitable for the harsh environmental conditions at the place of use. The strip production system can also be changed by increasing the number of roll stands, etc., without departing from the inventive concept.

What is claimed is:

1. A continuous casting device for positioning at least one of two casting rolls in a continuous casting process for producing metal strip comprising:

at least one frame element, at least one pair of lifting elements for each casting roll to be positioned, each lifting element rotatably mounted at a first end about a fixed first axis of rotation disposed on the at least one frame element, wherein the first axes of rotation of the lifting elements have a common first longitudinal axis, for each lifting element, a lifting cylinder disposed on the at least one frame element, wherein the lifting cylinder acts on a second end of the respective lifting element and is therefore connected in an articulated manner, at least one seating arrangement for each lifting element accommodating at least one bearing arrangement to rotatably mount one end of the casting roll to be positioned, wherein the at least one seating arrangement is disposed on an upper side of the lifting element, and for each lifting element, a lever stop disposed on the at least one frame element, wherein a contact surface disposed on an underside of the respective lifting element is in contact with a stop surface of the respective lever stop at least when the respective lifting cylinder is in an idle position.

2. The continuous casting device of claim 1, comprising a second pair of lifting elements, each rotatably mounted at a first end about a fixed second axis of rotation disposed on the at least one frame element, wherein the second axes of rotation have a common second longitudinal axis which is disposed parallel to the first longitudinal axis, and wherein the first ends of the lifting elements of the two pairs of lifting elements are facing one another.

3. The continuous casting device of claim 1, comprising a drive unit for each casting roll, each drive unit configured to impart rotation about its longitudinal axis to the respective casting roll positionable by means of the pair of lifting elements.

4. The continuous casting device of claim 3, wherein the drive unit is assigned to one of the lifting elements of the respective pair of lifting elements and is disposed on the at least one bearing arrangement disposed on the lifting element.

5. The continuous casting device of claim 4, wherein a counterweight is disposed opposite the drive unit.

6. The continuous casting device of claim 1, wherein the spacing between the lifting elements of the respective pair of lifting elements can be changed such that the spacing can be adjusted to the length of the casting roll to be supported by the pair of lifting elements.

7. The continuous casting device of claim 1, wherein, in the region of the first axis or axes of rotation and possibly of the second axis or axes of rotation, at least one coolant supply line is connected for supplying coolant to the respective casting roll.

8. The continuous casting device of claim 1, wherein the at least one bearing arrangement is connected to the at least one seating arrangement via a pivot bearing.

9. The continuous casting device of claim 1, wherein the at least one bearing arrangement is height-adjustable with respect to the at least one seating arrangement.

10. The continuous casting device of claim 1, wherein the at least one bearing arrangement for each lifting element has at least one force measuring unit for determining the compressive force exerted by the casting roll on the at least one bearing arrangement.

11. The continuous casting device of claim 1, wherein a frame element is present for each pair of lifting elements.

12. The continuous casting device of claim 1, comprising at least one of: position encoder installed on each lifting cylinder and a rotary encoder installed on each axis of rotation.

13. The continuous casting device of claim 1, wherein the device additionally comprises a control device configured to set the position of the lifting cylinders as a function of at least one casting parameter affecting at least one of a strip thickness and a surface profile of the metal strip.

14. The continuous casting device of claim 13, wherein the casting parameters can be selected from the group consisting of:

a compressive force exerted by the at least one casting roll on the at least one bearing arrangement, a surface quality of the at least one casting roll, a strip thickness of the metal strip, a speed of the metal strip, a temperature or temperature distribution of the metal strip, a spatial position of the metal strip, a surface profile of the metal strip, a gap width of the casting gap, a temperature of a molten metal to be cast, a temperature of a coolant for cooling the casting rolls; and drive data of the drive units for driving the casting rolls.

* * * * *